United States Patent [19]

Takeuchi et al.

[11] Patent Number: 4,694,749

[45] Date of Patent: Sep. 22, 1987

[54] METHOD OF PRESETTING PLATE CYLINDERS FOR REGISTERING IN AN OFFSET PRINTING PRESS

[75] Inventors: Hideo Takeuchi, Shiroi; Michiaki Kobayashi, Kitamoto; Osamu Yoritsune; Takemasa Matsumoto, both of Mihara, all of Japan

[73] Assignees: Dai Nippon Insatsu Kabushiki Kaisha; Mitsubishi Jukogyo Kabushiki Kaisha, both of Tokyo, Japan

[21] Appl. No.: 793,790

[22] Filed: Nov. 1, 1985

Related U.S. Application Data

[63] Continuation-in-part of Ser. No. 653,840, Sep. 24, 1984, abandoned.

[30] Foreign Application Priority Data

Sep. 30, 1983 [JP] Japan ..... 58-182315

[51] Int. Cl.[4] ..... B41F 5/06; B41F 13/12

[52] U.S. Cl. ..... 101/426; 101/181

[58] Field of Search ..... 101/181, 248, 365, 183, 101/211, 426, 177, 217, 137, 138, 139, 143; 226/2, 3, 28–31, 34, 40, 41

[56] References Cited

U.S. PATENT DOCUMENTS

| | | | |
|---|---|---|---|
| 3,746,957 | 7/1973 | Forster et al. | 318/696 |
| 3,774,536 | 11/1973 | Raymond et al. | 101/365 X |
| 3,835,777 | 9/1974 | Krygeris | 101/365 |
| 4,004,510 | 1/1977 | Roch | 101/228 |
| 4,484,522 | 11/1984 | Simeth | 101/248 |

FOREIGN PATENT DOCUMENTS 2024457 1/1980 United Kingdom .

*Primary Examiner*—J. Reed Fisher
*Attorney, Agent, or Firm*—Parkhurst & Oliff

[57] ABSTRACT

An operation of presetting plate cylinder for automatic registration is carried out in a manner that rotational phase, lateral and twist errors of each plate cylinder are corrected by conventional means and then delamination errors are corrected on the basis of values calculated by using functional expressions concerning statistics. In order to carry out the operation, an apparatus for presetting plate cylinders has register error correcting means, control means for operating the delamination errors and a delamination error correcting means.

3 Claims, 24 Drawing Figures

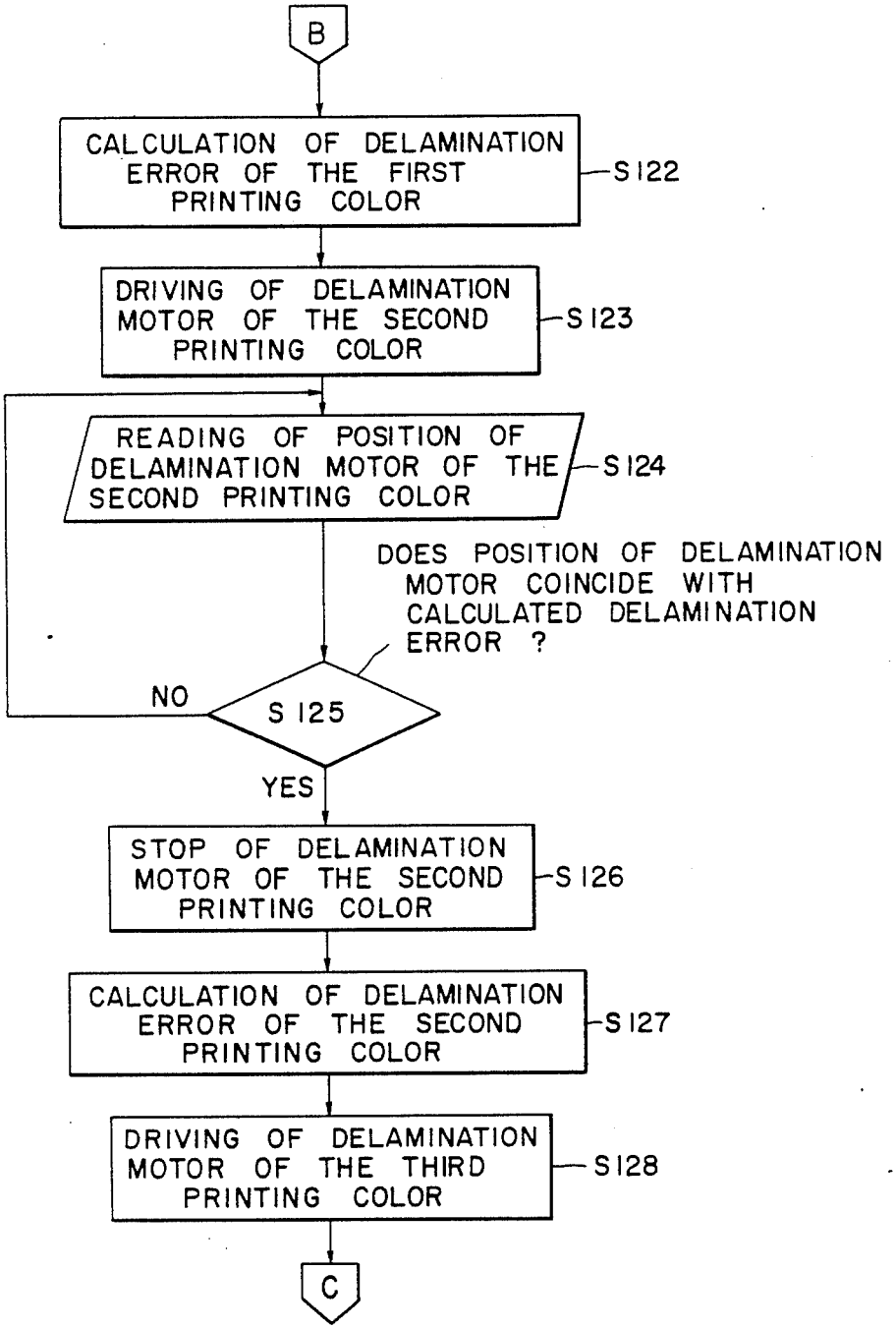
FIG. 12 (c1)

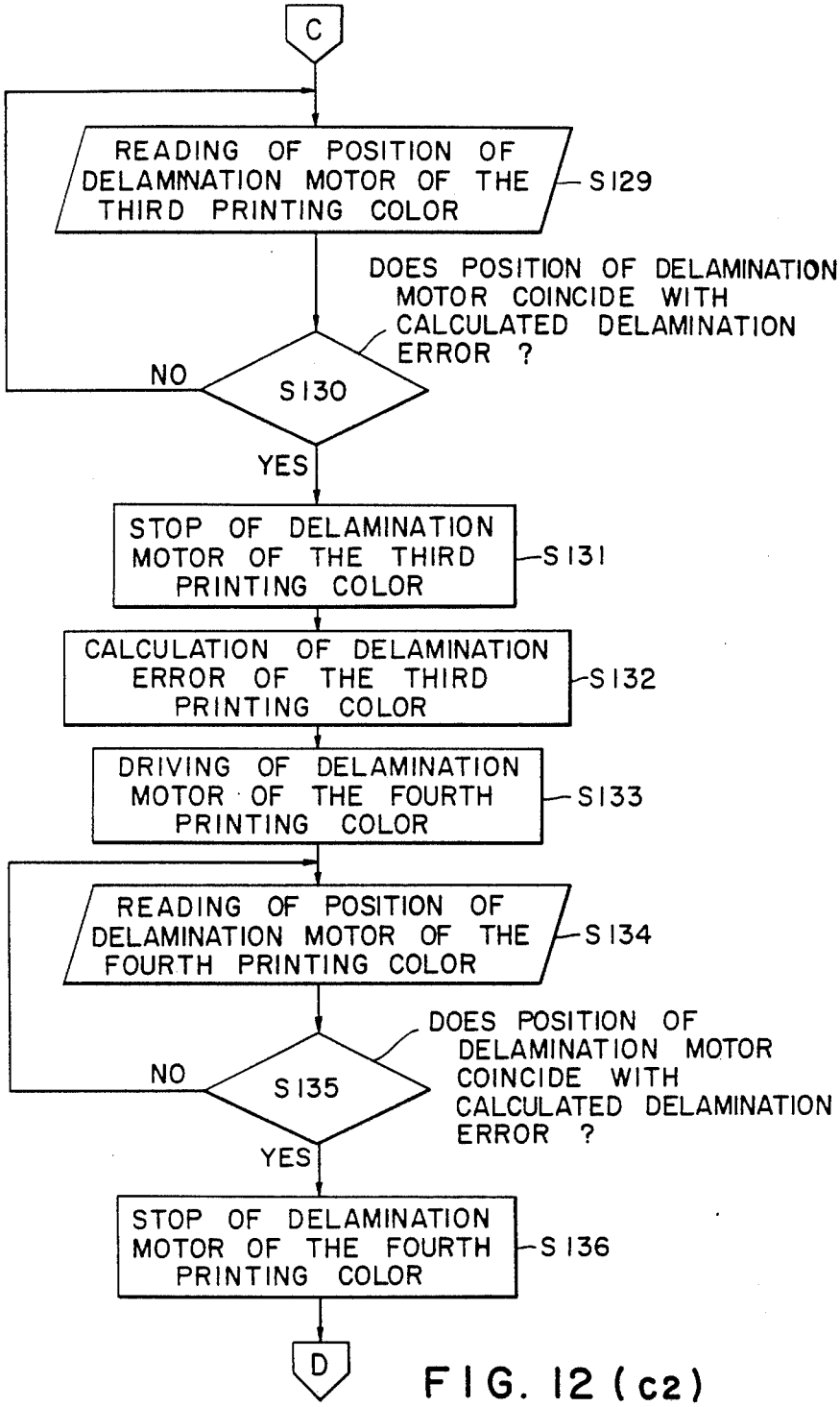
FIG. 12 (c2)

METHOD OF PRESETTING PLATE CYLINDERS FOR REGISTERING IN AN OFFSET PRINTING PRESS

This is a continuation-in-part of application Ser. No. 653,840 filed Sept. 24, 1984, now abandoned.

BACKGROUND OF THE INVENTION

This invention relates to an apparatus for and method of presetting plate cylinders to eliminate registering errors in an offset printing press before a printing operation.

An offset printing press for multicolor printing ordinarily has four printing units each provided with a plate cylinder, a blanket cylinder, etc. A printing plate is mounted on the outer peripheral surface of the plate cylinder of each printing unit. It is impossible to mount all printing plates on their plate cylinders with exactly the same registering phase relationships. That is, there are always some slight phase deviations in the rotational, lateral and oblique directions among the plate cylinders. The phase deviation in the oblique direction means that a printing plate is mounted obliquely on its plate cylinder in a twisted state.

In order to match the phases of all plate cylinders heretofore, a certain number of the plate cylinders have been slightly adjusted for registering while printing test (proofing) is carried out many times. This procedure takes much time and causes much waste of paper.

To avoid this, there have been proposed a variety of apparatuses for presetting multiple-color plate cylinders for registering.

For example, there is a presetting apparatus for registering which has a computer. The computer once memorizes the magnitude of register adjustment at the time when each plate cylinder is set in a correct position according to the kind of printing paper. When the same kind of printing paper is thereafter used, each plate cylinder is preset for registering on the basis of data previously memorized in the computer.

In addition to the above conventional apparatus, there is another conventional presetting apparatus which has a plurality of sensors for detecting register marks formed on a printing plate mounted on each plate cylinder. Each sensor detects the phase deviations of the plate cylinders to carry out a registering operation.

In the former conventional presetting apparatus, however, whenever a new printing plate is mounted on each plate cylinder, the mounting operation of the printing plate newly causes phase deviations. The phase deviations due to one mounting operation are different from those of other mounting operations. Accordingly, the data for a presetting operation previously memorized in the computer are not necessarily applicable to a new printing operation even if the same kind of printing paper is used because of a difference in the phase deviations among a plurality of the mounting operations. This results in carrying out the printing test (proofing) many times.

The latter conventional apparatus also requires repeated proofs because of the following reasons.

As a rule, when a web or a continuous printing paper is used in an offset printing press, the web passes between a pair of blanket cylinders in each printing unit so that ink on the blanket cylinders is transferred to the surface of the web. At this time, there often occurs a delamination which means that the web is pulled by either the upper or lower blanket cylinder in the rotational direction thereof because the web is caused to adhere to the surface of the blanket cylinder by the viscosity of the ink. As a result, if the delamination occurs, there will be a change of the length of the web extending between the two adjoining printing units. This causes a register error in the rotational direction of the plate cylinder, which register error changes in accordance with printing conditions such as the tension, the width, the weight per unit length of the web and the area of patterns on a printing plate.

In the latter conventional presetting apparatus, the presetting operation has not been carried out in consideration of the delamination and proofing has been carried out before a normal printing operation in order to eliminate the error caused by the delamination.

SUMMARY OF THE INVENTION

In view of the above described problems, it is an object of the invention to provide a method of and an apparatus for presetting plate cylinders for registering in an offset printing press in which each plate cylinder can be preset in consideration of delamination error in addition to lateral, rotational phase and twist errors thereby to remarkably reduce a period of time for registering and a waste of paper.

According to one aspect of this invention, there is provided a method of presetting plate cylinders for registering before the start of a printing operation in an offset printing press, which comprises steps of: (a) correcting rotational phase, lateral and twist errors of each plate cylinder without considering a delamination error while detecting register marks on a printing plate mounted on each plate cylinder; (b) calculating tension of a web on the basis of a functional expression with respect to statistics and operating tension adjusting means on the basis of a calculated value of web tension; (c) calculating a delamination error of each plate cylinder corresponding to each printing color on the basis of at least one functional expression with respect to statistics and operating delamination error correcting means on the basis of a calculated value of a delamination error with respect to each plate cylinder corresponding to each printing color; and (d) carrying out self-learning in order to determine coefficients of functional expressions with respect to web tensions and delamination errors during printing operations.

According to another aspect of this invention, there is provided an apparatus for presetting plate cylinders for registering before the start of a printing operation in an offset printing press, which comprises: (a) register error correcting means for correcting rotational phase, lateral and twist errors of each plate cylinder while detecting register marks on a printing plate mounted on each plate cylinder; (b) control means for operating the magnitude of the delamination error of each plate cylinder on the basis of printing conditions such as the width, weight per unit length and tension of a web, area of patterns on a printing plate mounted on each plate cylinder thereby to output a signal for correcting the delamination error of each plate cylinder; and (c) delamination error correcting means for changing the rotational phase of each plate cylinder in response to the signal from the control means.

The nature, utility, and further features of this invention will be more clearly apparent from the following detailed description with respect to preferred embodiments of the invention when read in connection with the accompanying drawings, briefly described below.

DETAILED DESCRIPTION OF THE INVENTION

First of all, a delamination will be explained with reference to FIG. 1.

Figure 1:
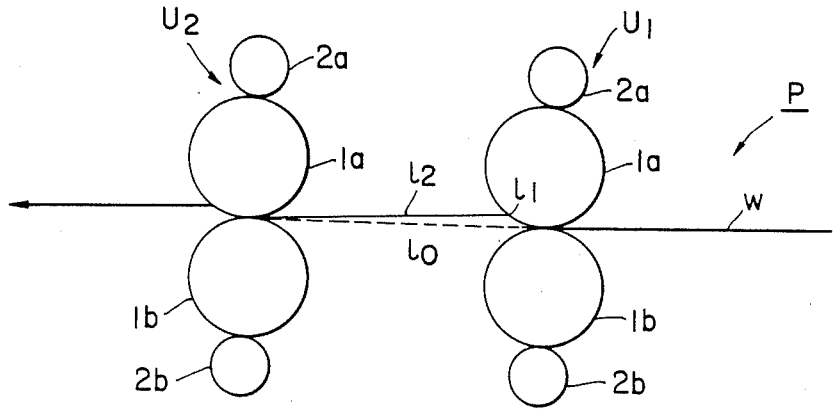
FIG. 1 is a side elevational view of two printing units in an offset printing press, showing a delamination.

An offset printing press P has a plurality of printing units $U_1$, $U_2$ (only two units are shown in FIG. 1). The printing unit $U_1$ has an upper and a lower blanket cylinders 1*a*, 1*b* opposite to each other and an upper and a lower plate cylinders 2*a*, 2*b* each located outside the respective blanket cylinders 1*a*, 1*b*. Likewise, the printing unit $U_2$ has two blanket cylinders 1*a*, 1*b* and two plate cylinders 2*a*, 2*b*. A web w runs between the two blanket cylinders 1*a*, 1*b* of each unit.

When the web w passes between the two blanket cylinders 1*a*, 1*b*, the web w often adheres to the outer peripheral surface of either of the upper and lower blanket cylinders 1*a*, 1*b* thereby to be pulled in the rotational direction of one of the blanket cylinders 1*a*, 1*b* to which the web w adheres because of the viscosity of ink. As a result, the length of the web w between the two units $U_1$, $U_2$ becomes large by a value $\Delta l(l_1+l_2-l_0)$. This causes a phase deviation in registering in the rotational direction of the plate cylinders 2*a*, 2*b*.

To eliminate the phase deviation in the rotational direction of the plate cylinders 2*a*, 2*b*, an apparatus of this invention has the following structure.

Figure 2:
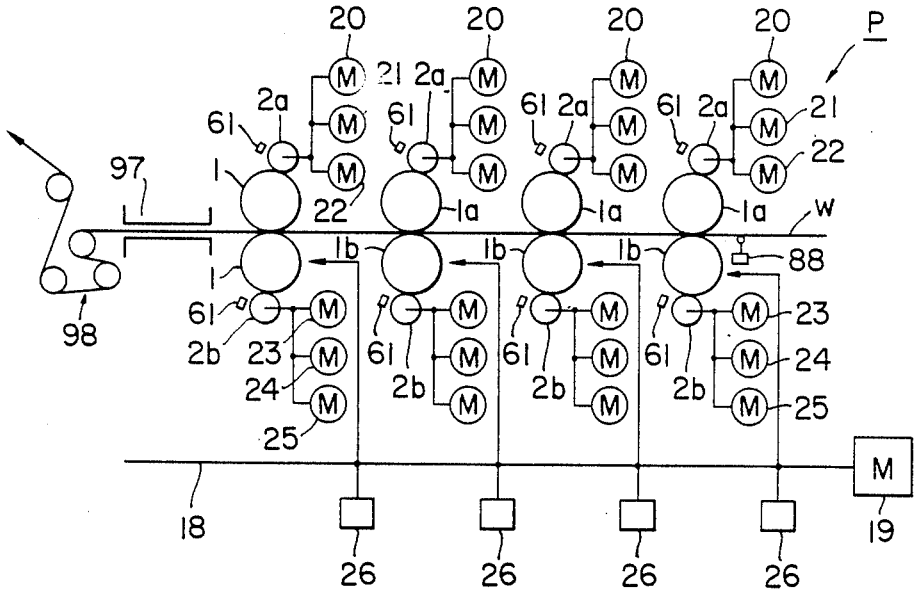
FIG. 2 is a schematic side elevational view of an offset printing press, to which a presetting apparatus of this invention is adapted.
Figure 3:
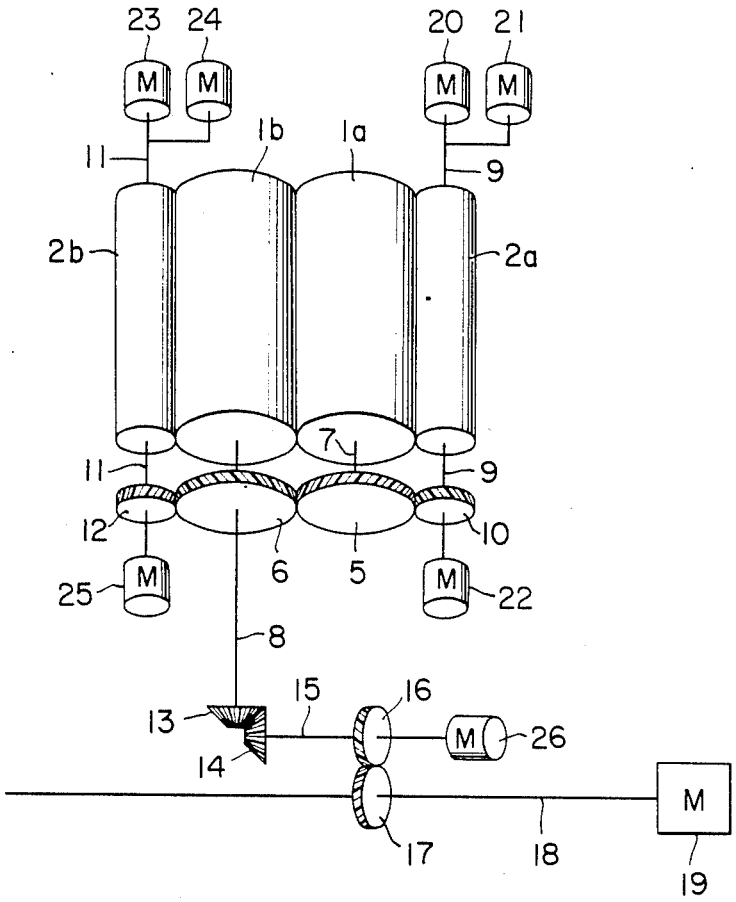
FIG. 3 is an enlarged view of a printing unit, showing a schematic construction of the presetting apparatus of this invention.

In FIGS. 2 and 3, an offset printing press P has four printing units $U_1$, $U_2$, $U_3$, $U_4$ each of which is provided with an upper and a lower blanket cylinders 1*a*, 1*b* and an upper and a lower plate cylinders 2*a*, 2*b*. The two blanket cylinders 1*a*, 1*b* contact each other and have two helical gears 5, 6 via two cylinder shafts 7, 8, respectively. The two helical gears 5, 6 are meshed with each other. The upper plate cylinder 2*a* contacts the upper blanket cylinder 1*a* while the lower plate cylinder 2*b* contacts the lower plate cylinder 2*a*. The upper plate cylinder 2*a* is provided with, via a cylinder shaft 9, a small helical gear 10 which is meshed with the helical gear 5 while the lower plate cylinder 2*b* is provided with, via a cylinder shaft 11, a small helical gear 12 which is meshed with the helical gear 6. To the distal end of the shaft 8 of the lower blanket cylinder 1*b* is fixed a bevel gear 13 which is meshed with a bevel gear 14. The bevel gear 14 is connected to a axis 15 in a spline engagement relationship. To the axis 15 is fixed a helical gear 16 which is meshed with a helical gear 17 provided on a main driving shaft 18. The main driving shaft 18 is driven by a main driving motor 19. The rotation of the main driving motor 19 causes a synchronous rotation of the four cylinders 1*a*, 1*b*, 2*a*, 2*b* through a gear transmission mechanism comprising a group of the above gears 5, 6, 10, 12, 13, 14, 16, 17.

Figure 5:
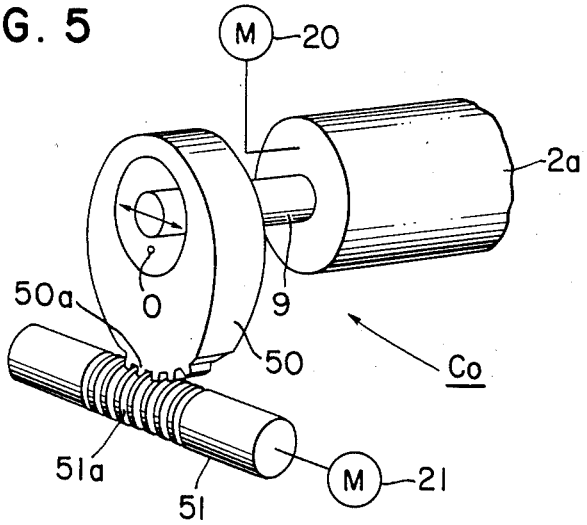
FIG. 5 is a perspective view of a cocking device.

To the upper plate cylinder 2*a* is connected a lateral deviation (error) correcting motor 20 for moving the upper plate cylinder 2*a* in its lateral direction thereby to adjust the lateral deviation thereof. On the same side of the upper plate cylinder 2*a* as that of the lateral deviation correcting motor 20, there is provided a twist deviation correcting motor 21 for moving one end of the upper plate cylinder 2*a* in the tangential direction of the upper blanket cylinder 1*a* via a known cocking device as shown in FIG. 5 thereby to adjust the twist deviation of the upper plate cylinder 2*a*. In addition to the above two motors 20, 21, a rotational phase deviation correcting motor 22 for adjusting the rotational phase deviation of the cylinder 2*a* is connected to the small helical gear 10. The motor 22 functions to move the small helical gear 10 in its axial direction to change the engaging condition between the two helical gears 5, 10 whereby the rotational phase of the cylinder 2*a* can be changed.

The shaft 9 is connected to the gear 10 in a spline engagement.

Figure 4:
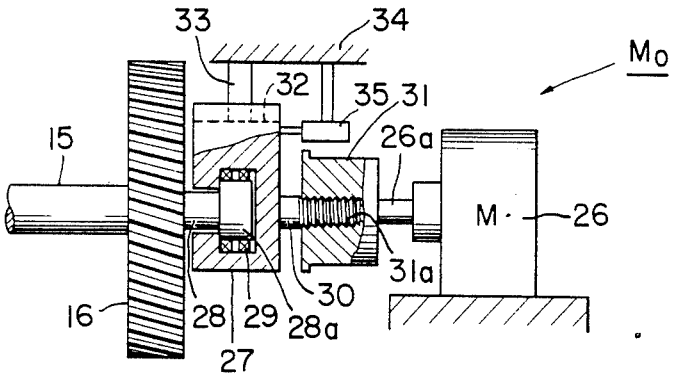
FIG. 4 is a side elevational view of a gear moving mechanism, with a part thereof cut away.

Likewise, the lower plate cylinder 2*b* is provided with a lateral deviation correcting motor 23, a twist deviation correcting motor 24 and a rotational phase deviation correcting motor 25. To the helical gear 16 on the axis 15 is connected a delamination deviation correcting motor 26 which functions to move the helical gear 16 in its axial direction via a gear moving mechanism $M_0$ as shown in FIG. 4.

The gear moving mechanism $M_0$ comprises a holding body 27 for holding a rotational axis 28 projecting from the center of the helical gear 16 in its axial direction. The axis 28 has an expanded portion 28*a* at its distal end which is rotatably held in the holding body 27 via a thrust bearing 29. To the holding body 27 is fixed a screw bar 30 which is engaged with a female screw portion 31*a* formed in a rotational member 31. The rotational member 31 is fixed to a driving axis 26*a* of the motor 26. On the upper surface of the holding member 27 is formed a guide groove 32 extending in the moving direction of the gear 16. In the guide groove 32 is slidably inserted the lower end of a guide bar 33 which is fixed to a wall 34. The engagement of the guide bar 33 and the guide groove 32 prevents the holding member 27 from rotating about its axis. The rotation of the motor 26 causes the holding body 27 to move in the right and left directions as viewed in FIG. 4 whereby the gear 16 is moved in the same direction. A potentiometer 35 is provided near the side wall of the holding body 27 in order to detect the position of the holding body 27, that is, the position of the gear 16. The potentiometer 35 may be a differential transformer in which a core is moved in an induction coil.

The same gear moving mechanism (not shown) as the above gear moving mechanism $M_0$ is provided between the gear 10 and the rotational deviation correcting motor 22 as well as between the gear 12 and the rotational deviation correcting motor 25. The two lateral deviation correcting motors 20, 23 are connected to the plate cylinders 3, 4 via two plate cylinder moving mechanisms (not shown) similar to the above gear moving mechanism $M_0$, respectively. The respective lateral deviation correcting motors 20, 23 move the plate cylinders 3, 4 in their lateral directions thereof which are supported by the two shafts 9, 11 in a spline engaging relationship, respectively.

The twist deviation correcting motors 21, 24 are connected to the shafts 9, 11 of the plate cylinders 2*a*, 2*b* via two cocking devices $C_0$ as shown in FIG. 5, respectively. FIG. 5 shows a cocking device for the upper plate cylinder 2*a*. That is, the plate cylinder 2*a* is so rotatably supported that its operative side can be moved foreard and rearward relative to its driven side (helical gear side). This movement can be caused by rotating a rotating shaft bearing 50 mounted around the cylinder shaft 9 of the plate cylinder 2*a* with an upward eccentricity through a very small angle of rotation by means of a driving shaft 51 driven in rotation by the above mentioned twist deviation correcting motor 21.

The rotating shaft bearing 50 is provided at its lower part with screw threads 50*a* constituting a sector gear which is meshed with screw threads 51*a* formed around the driving shaft 51 and constituting a worm gear. When the driving shaft 51 is rotated, it causes the rotating shaft bearing 50 to rotate about its center 0, whereby the corresponding end of the cylinder shaft 9 of the plate cylinder 2*a* is moved slightly in the left and right directions as viewed in FIG. 5, or substantially parallelly to the driving shaft 51. This correction results in a deviation of the tangential line between the plate cylinder 2*a* and the blanket cylinder 1*a*.

Figure 6:
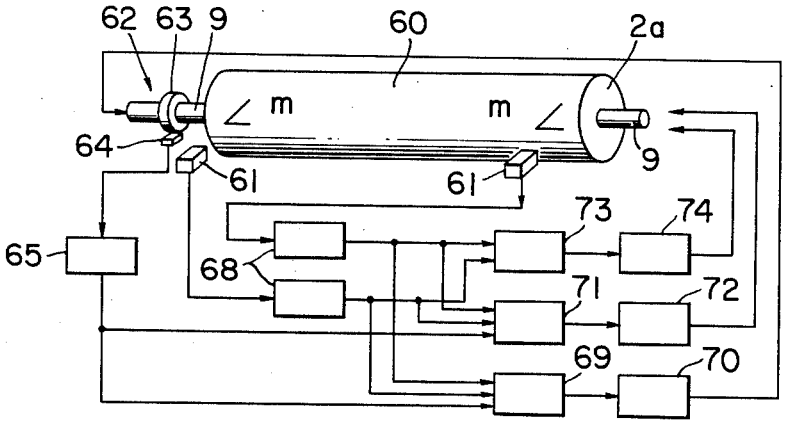
FIG. 6 is a combination of a schematic perspective view and a block diagram showing a system for correcting error quantity in registering.

On each plate cylinder is mounted a printing plate 60 which has two ∠-shaped register marks m, m formed near its opposite side ends as shown in FIG. 6. In order to detect the register marks m, m, two optical sensors 61, 61 are provided at positions confronting the plate surface of each plate cylinder.

On the cylinder shaft 9 of the plate cylinder is provided a datum point setting device 62 comprising a setting plate 63 disposed coaxially around the cylinder shaft 9 and a sensor (proximity switch) 64 for detecting the setting plate 63. The sensor 64 is connected to a datum point signal generator 65 for generating a signal when the plate 63 arrives at a previously set reference position.

Figures 7A, 7B, 7C:
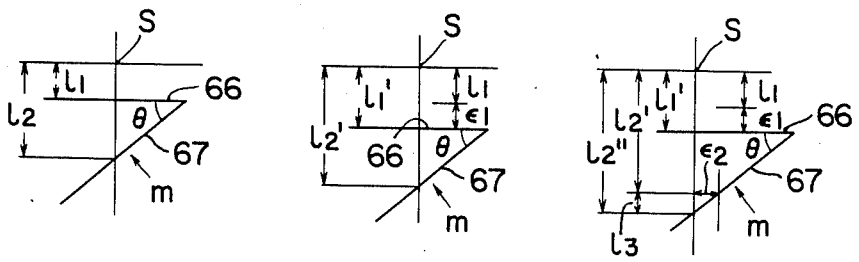
FIGS. 7(*a*), 7(*b*) and 7(*c*) are plan views for an explanation of the principle of the system shown in FIG. 6.

The optical sensors 61, 61 on the left and right determine, as indicated in FIG. 7, the distances between a datum point S set by the datum point setting device 62 and a horizontal fine line 66 of the register mark m and between the datum point S and an inclined fine line 67 forming an angle $\theta$ with the horizontal fine line 66. When the registering is correct, the distances $l_1$ from the datum points S to respective fine lines 66 and to respective fine lines 67 of all marks of a plate cylinders will become respectively equal. The state of the register mark in each plate cylinder will then become as indicated in FIG. 7*a*.

Each optical sensor 61 is connected to a mark detecting circuit 68 for generating a pulse when the sensor 61 detects the horizontal fine line 66 and the inclined fine line 67 of the register mark m. Signals from the circuit 68 are input into three circuits 69, 71 and 73, respectively. The circuit 69 is for calculating a rotational error $\epsilon_1$ as shown in FIG. 7(*b*). For example, the error $\epsilon_1$ is obtained in such a manner that the distance $l_1$ is subtracted from a distance $l_1'$ between the datum point S and the horizontal line 66. The error $\epsilon_1$ is expressed as a number of pulses. The circuit 71 is for calculating a lateral deviation error $\epsilon_2$ and the circuit 73 is for calculating a twist error.

In the case where, with respect to the rotational datum position, the error of $\epsilon_1$ is detected in only the rotational direction with respect to the distance from the datum point S as indicated in FIG. 7*b*, the resulting detection signal is passed through a mark detecting circuit 68 and introduced as input into a circuit 69 for detecting the magnitude of error in the rotational direction. A motor driving circuit 70 for plate cylinder phase correction then operates in response to the resulting output signal from this circuit 69 to match the rotational phases of all plate cylinders. The circuit 69 has a counter for counting the distance $l_1'$ and a subtracter. The distance $l_1$ is previously input as a datum distance.

Deviation errors in the respective directions are obtained as a number of pulses generated by a pulse generator (not shown).

Driving circuits 70, 72, 74 connected to the respective circuits 69, 71, 73 drive the respective deviation correcting motors 20, 21, 22 according to the number of pulses output from the circuits 69, 71, 73.

Furthermore, in the case where each of the left and right register marks m of a certain plate cylinder is deviantly displaced equally in both the rotational direction and the lateral direction as indicated in FIG. 7*c*, the deviation $\epsilon_1$ in the rotational direction is corrected in the above described manner. At the same time, the deviation $\epsilon_2(=l_3\tan(90°-\theta);\ l_3=l_2''-l_2'=l_2''-l_2-\epsilon_1)$ in the lateral direction is detected by the circuit 71 for calculating the magnitude of error in the lateral direction, and the resulting detection signal from this circuit 71 is fed as input into the driving circuit 72 for driving the plate in the lateral direction. As a result, the plate cylinder itself is moved in the lateral direction and thereby positionally corrected by known means. If the angle $\theta$ of the mark m is 45°, $\epsilon_2=l_3$. Accordingly, the circuit 71 has a counter for counting the distance $l_2''$ and a subtracter, the distance $l_2$ is previously input as a datum distance and the error $\epsilon_1$ is input from the circuit 69.

When, on one plate cylinder, the distance between the datum point S and the inclined line 67 of the right register mark m is different from that between the datum point S and the inclined line 67 of the left register mark m ($l_2''$ of the right register mark $\neq l_2''$ of the left register mark), this indicates that the plate P is mounted in a twisted state on the plate cylinder. Therefore, this twist error ($l_2''$ of the right register mark $-l_2''$ of the left register mark) is detected with the twist magnitude detection circuit 73, the detection output of which is fed into a twist correction motor driving circuit 74. Accordingly, the circuit 73 has a counter for counting the distances $l_2''$ of right and left register marks m and a subtracter.

The method and apparatus for automatic registration described above are well known and disclosed in Japanese Pat. Publication No. 25062/1980 in detail.

Figure 8:
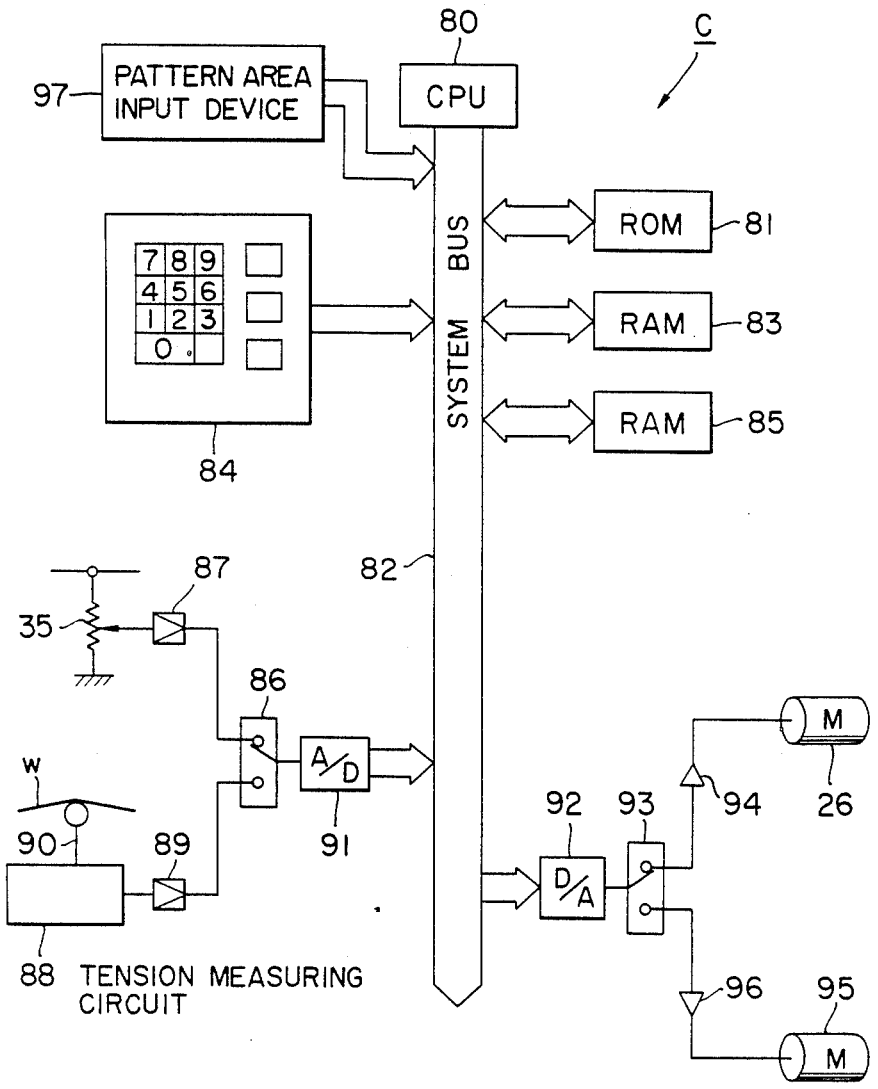
FIG. 8 is a block diagram showing the control system of a computer.

These above circuits 68 to 74 are controlled by a central processing unit (CPU) 80 of a computer C as shown in FIG. 8. The CPU 80 is connected, via a system bus 82, to a read-only memory (ROM) 81, a random access memories (RAM) 83 for memorizing rates of pattern area read from a magnetic card and a RAM 85 for memorizing various past printing conditions.

These above computer circuits and other units are for correcting the rotational phase error, lateral error and twist error of each plate cylinder without considering the delamination error thereof. In addition to these above computer circuits and other units, the computer C has also a plurality of circuits and units for correcting a phase deviation in the rotational direction of each plate cylinder, caused by a delamination. That is, there is provided a key board type input unit 84 for inputting printing conditions such as width of a web to be printed, the weight per unit length of a web, etc. into the computer C. The input unit 84 inputs the printing conditions into the computer C with respect to each printing unit. The printing conditions input by the input unit 84 are memorized by the random access memories (RAM) 85.

The potentiometer 35 of each printing unit shown in FIG. 4 is connected to a multiplexor 86 via an amplifier 87. To the multiplexor 86 is also connected, via an amplifier 89, a tension measuring circuit 88 for measuring a tension of a web w. The circuit 88 detects the movement of a tension sensor 90, in the form of a roll, contacting the web w. The tension sensor 90 is ordinarily located on the upstream side of the first unit $U_1$. The data from the tension measuring circuit 88 and the potentiometer 33 are input into the computer C via an analog-to-digital converter (A/D converter) 91.

Figure 11:
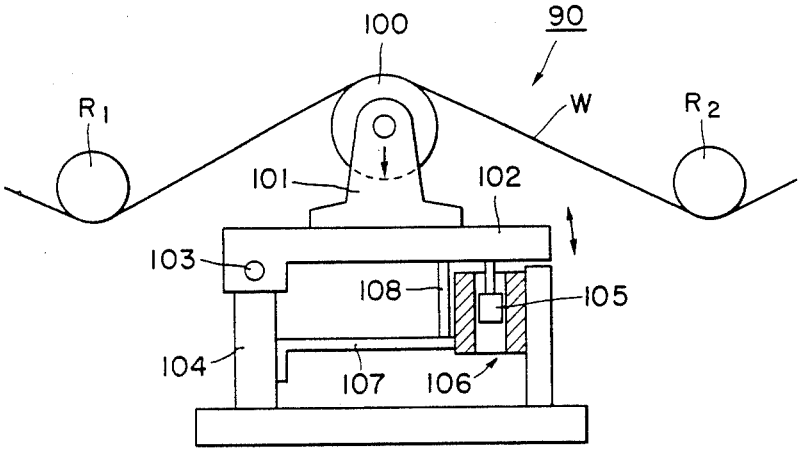
FIG. 11 is a side view of a tension measuring apparatus.

The tension sensor 90, as shown in FIG. 11, is well known and has a roll 100 supported by a frame 101 which is mounted on a swingable base 102. This base 102 is swingable about an axis 103 provided on a column 104. A core 105 is supported by the lower end of the base 102 and forms a part of a differential transformer 106 by which the movement of the base 102 can be detected. The base 102 is swingably supported by a spring plate 107 through a support member 108. Thus, tension of a web w extending along two rolls $R_1$, $R_2$ and the tension measuring roll 100 is measured.

On the other hand, an output signal for correcting a delamination error is delivered to the delamination deviation correcting motor 26 via a digital-to-analog converter 92, multiplexor 93 and a motor drive circuit 94. To the multiplexor 93 is connected a tension adjusting motor 95 for adjusting the tension of the web w via a motor drive circuit 96. The tension adjusting motor 95 drives a known tension adjusting device (not shown). The motor 26 is provided in each printing unit. However, only one motor 26 is shown in FIG. 8.

Figure 10:
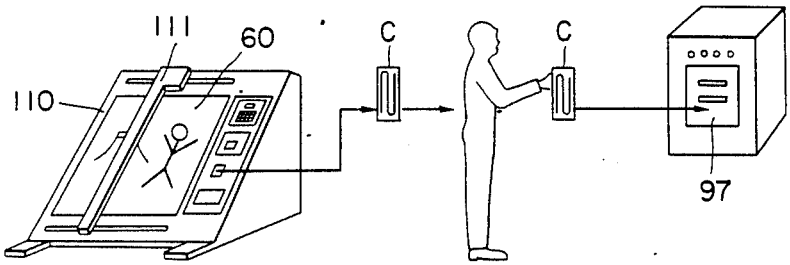
FIG. 10 is a view showing a plattern area measuring apparatus.

To the system bus 82 is connected a pattern area input device 97 which inputs rates of pattern area measured by a well known pattern area measuring device 110 for measuring the rate or the amount of area to which ink of a certain color is adhered on a printing plate as shown in FIG. 10. The data of pattern on a magnetic card c are read by the input device 97. The printing plate 60 is put on a table surface of the device 110 and a measuring head 111 is moved over the printing plate 60 in order to measure the rates of pattern area. The data of the rates of pattern area are recorded on the magnetic card c. In the case of four-color printing, four magnetic cards are prepared, corresponding to four colors. Such a pattern area measuring device is disclosed in U.S. Pat. Nos. 4,444,505 and 4,441,819 in detail.

The web w which has passed through the four printing units $U_1$ to $U_4$ enters a drying arrangement 97 for drying the web w and then passes through a group of cooling rollers 98.

The operation of the presetting apparatus of this invention will now be explained with reference to FIGS. 8, 9 and 12 to 15.

In this invention, tension of a web and delamination errors corresponding to four printing units are determined on the basis of regression analysis with respect to statistics.

As a rule, tension T of a web is expressed as functions of width W and weight per unit length M of a web, and each delamination error D corresponding to each printing unit is expressed as functions of tension T, width W and weight M of a web and rates of pattern area A corresponding to each printing plate. That is:

$$T=f_0(W) \quad (1)$$

$$T=f_1(M) \quad (2)$$

$$D=f_2(T) \quad (3)$$

$$D=f_3(W) \quad (4)$$

$$D=f_4(M) \quad (5)$$

$$D=f_5(A) \quad (6)$$

According to regression analysis, the above expressions (1) to (6) are expressed in the following manner.

$$T=a_0W+b_0 \quad (7)$$

$$T=a_1M+b_1 \quad (8)$$

$$D=c_0T+d_0 \quad (9)$$

$$D=c_1W+d_1 \quad (10)$$

$$D=c_2M+d_2 \quad (11)$$

$$D=c_3A+d_3 \quad (12)$$

wherein $a_0$, $a_1$; $b_0$, $b_1$; $c_0$, $c_1$, $c_2$, $c_3$; and $d_0$, $d_1$, $d_2$, $d_3$ are called regression coefficients, respectively.

Above linear expressions are generally expressed as $$Y=\alpha x+\beta \quad (13)$$

According to method of least squares, the two coefficients are obtained by using the following expressions.

$$\beta = \frac{\Sigma y_i \Sigma x_i - n\Sigma y_i x_i}{(\Sigma x_i)^2 - n\Sigma x_i^2} \quad (14)$$

-continued $$\alpha = \frac{\Sigma y_i x_i - \beta \Sigma x_i^2}{\Sigma x_i} \quad (15)$$

wherein n is a number of data, x is an independent variable and y is a dependent variable.

On the basis of various test data ($x_i$, $y_i$), the coefficients $\alpha$, $\beta$ are determined. Likewise, the above coefficients $a_0$ to $d_3$ are determined to specify the respective regression lines.

With respect to tension T of a web, two values are obtained on the basis of the two expressions (7), (8) while with respect to delamination errors, four values are obtained on the basis of the four expressions (9) to (12). To determine a suitable tension and a delamination error close to an actual delamination error, each value of tension T of a web and delamination error is averaged, respectively. That is, a suitable web tension $T_0$ is expressed as $$T_0 = \frac{f_0(W) + f_1(M)}{2} \quad (16)$$

On the other hand, a delamination error $D_0$ close to an actual delamination error is expressed as $$D_0 = \frac{f_2(T) + f_3(W) + f_4(M) + f_5(A)}{4} \quad (17)$$

Figure 12:
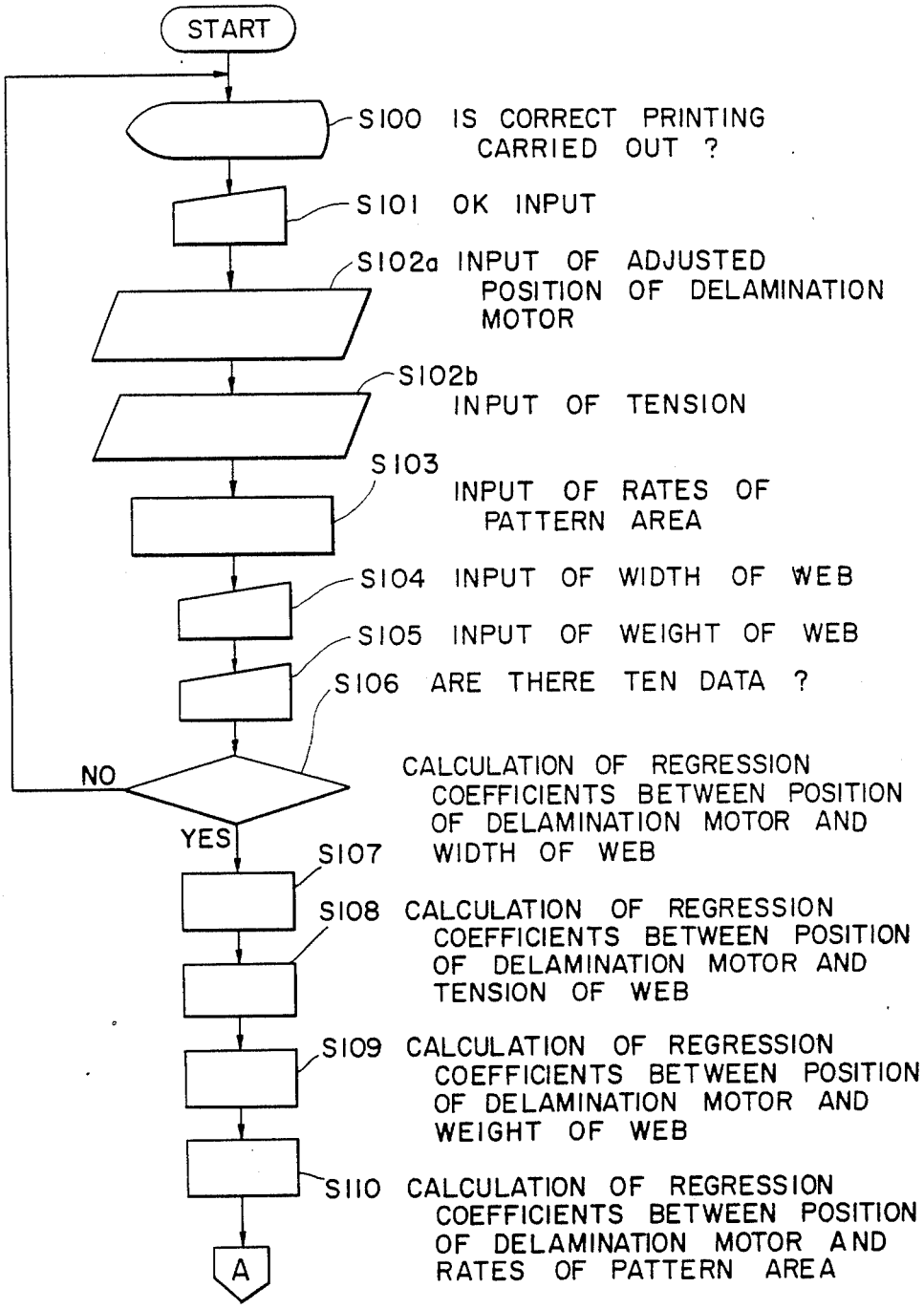
FIGS. 12(*a*) through (*d*) are flow charts showing detailed registering for delamination errors.
Figure 12:
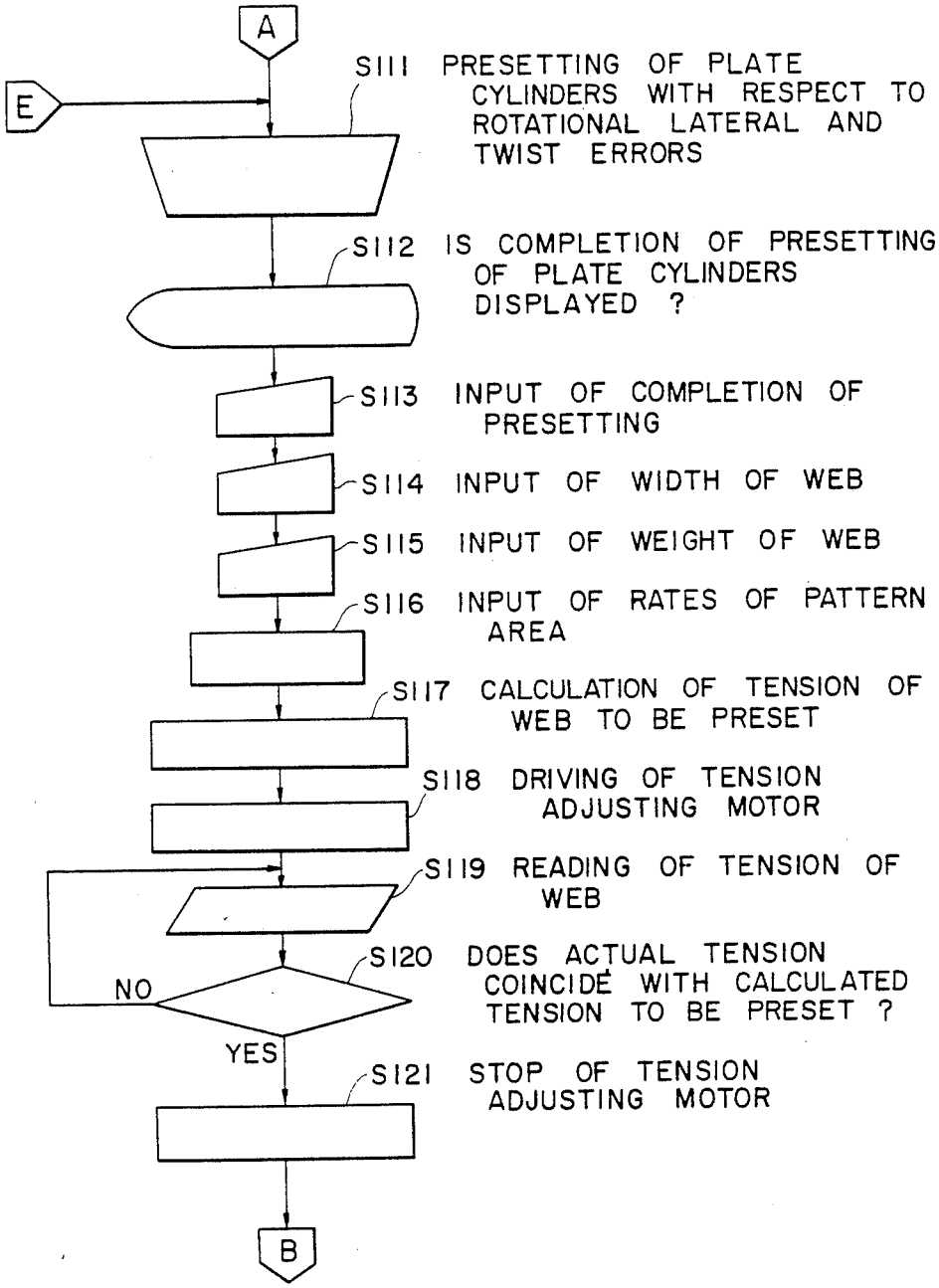
Figure 12:
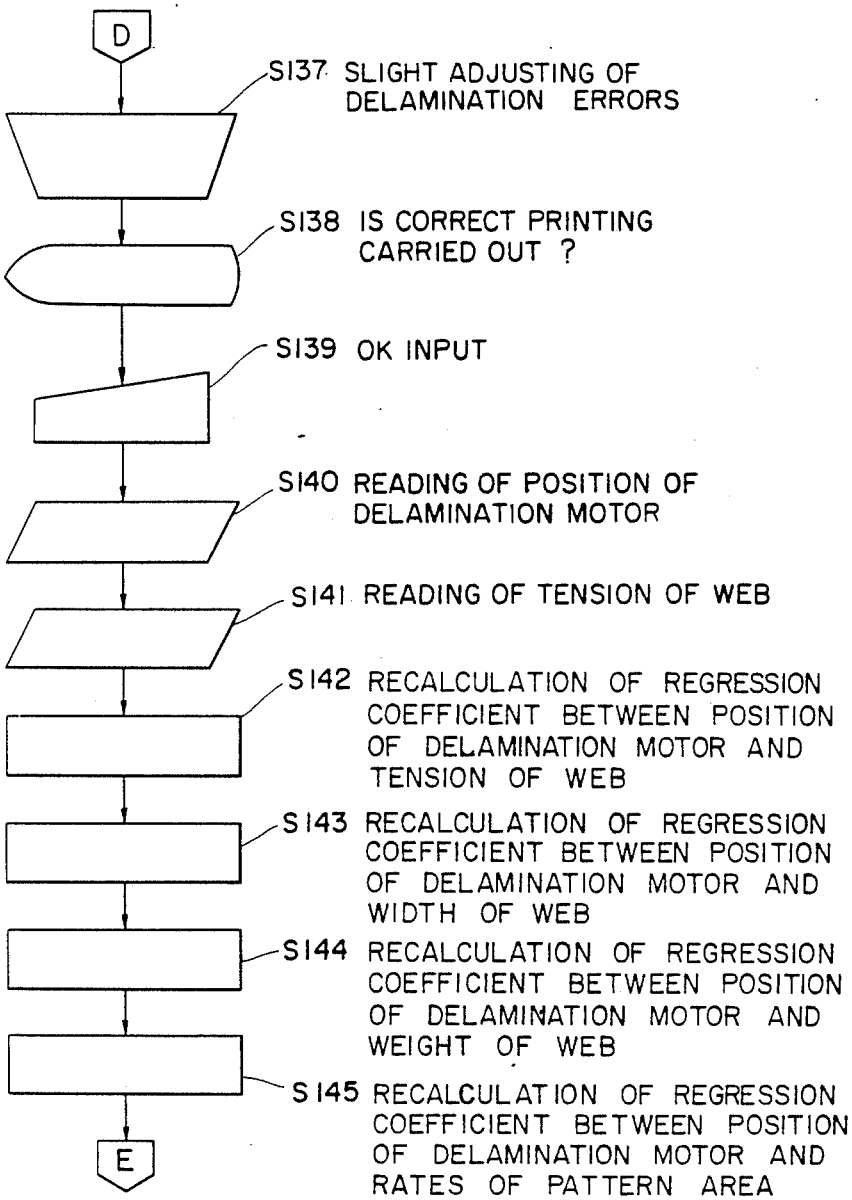

In FIG. 12, at first, some base data for presetting the plate cylinders are obtained so as to collect data of delamination errors, tension, width and weight of a web, and rates of pattern area. That is, in one printing operation, the most suitable position of the delamination deviation correcting motor 26 is obtained corresponding to a certain value of each of tension, width and weight of a web and rates of pattern area. The most suitable position of the motor 26 is adjusted by an operator by hand so that a delamination error corresponding to each printing unit (each printing color) is eliminated.

In a printing operation, whether a correct printing is carried out or not is displayed on a display (not shown) of the computer C (Step 100). The correct printing means that a printed article has no color deviation (shear of colors). That is, it means that the motor 26 is suitably adjusted. If the motor 26 is suitably adjusted the operator pushes a key button (OK button) of the input unit 84 ($S_{101}$). Then, the adjusted position of each motor 26 is read by each potentiometer 35 and is input into the RAM 83 ($S_{102a}$). In a normal delamination adjusting operation, the respective motors 26 of the printing units $U_2$, $U_3$ and $U_4$ are adjusted in a state wherein the motor 26 of the printing unit $U_1$ is left as it is. Thereafter, tension value is input through the tension sensor 90 ($S_{102b}$) and rates of pattern area are input by inserting, into the pattern area input device 97, each magnetic card c corresponding to each printing plate mounted on the respective printing units $U_1$, $U_2$ and $U_3$ ($S_{103}$). A delamination error of the printing unit $U_4$ has no influence on a printing condition. Therefore, rates of pattern area of the printing unit $U_4$ are not necessary. Then, width and weight per unit length of a web to be used are input through the input unit 84 ($S_{104}$, $S_{105}$). The same operation is repeated ten times ($S_{106}$).

Figure 14:
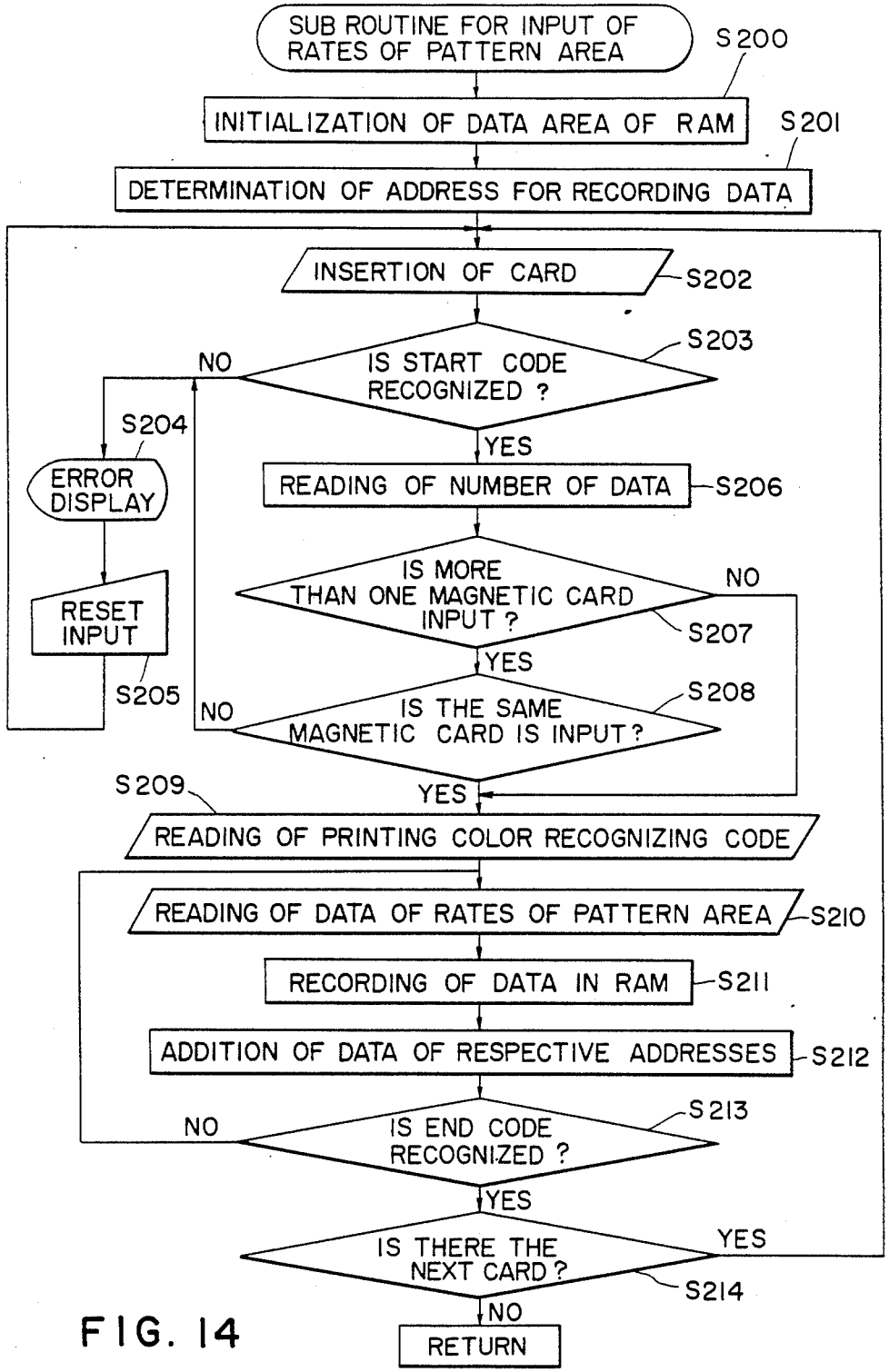
FIG. 14 is a flow chart showing a step in which rates of pattern area are input.

A step ($S_{103}$) for inputting the rates of pattern area is carried out in a manner as shown in FIG. 14.

First, data area of RAM 85 is initialized ($S_{200}$) and address for recording data is determined ($S_{201}$). After this, a magnetic card c is inserted into the pattern area input device 97 ($S_{202}$). A start code of the magnetic card c is then recognized ($S_{203}$). If the start code is not recognized, an error display is carried out ($S_{204}$) and the pattern area input device is reset for receiving the same or another magnetic card c.

In general, rates of pattern area are so measured that each printing plate is divided into a plurality of regions. Therefore, the magnetic card c has a plurality of data corresponding to the divided regions of each printing plate. The number of the divided regions corresponds to the number of doctor blades of an ink fountain. The number of data of rates of pattern area is read ($S_{206}$). Then, whether more than one magnetic card c have been input or not is recognized ($S_{207}$). If so, the data of the magnetic card c to be read at this time are compared with the data of a formerly read magnetic card c in order to prevent the same magnetic card c from being read ($S_{208}$). If the number of the present data is equal to that of the data of a magnetic card c formerly input, a code for indicating to what printing color (unit $U_1$, $U_2$ or $U_3$) the card c corresponds is read ($S_{209}$) and the data are then read ($S_{210}$). The data are recorded in data area of RAM 83 ($S_{211}$). Then, all data of respective addresses are added to each other to obtain a total value of rates of pattern area ($S_{212}$). Further, an end code of the magnetic card is recognized ($S_{213}$). If the end code is not recognized, operation is returned to the step $S_{210}$. If the end code is recognized and there is another card to be read, the card is inserted into the pattern area input device 97 ($S_{214}$).

Now back to the step ($S_{106}$) in FIG. 12, if ten basic data for presetting each plate cylinder are obtained, various regression coefficients are calculated. That is, two kind regression coefficients of a functional expression between position of each delamination deviation correcting motor 26 and tension of a web are calculated. In other words, in the above expression (9), the coefficients $c_0$, $d_0$ are calculated on the basis of the expressions (14), (15) ($S_{107}$).

Likewise, six regression coefficients between position of each motor 26 and other three printing conditions such as width and weight of a web and rates of pattern area corresponding to each printing color are calculated ($S_{108}$, $S_{109}$, $S_{110}$). That is, the coefficients ($c_1$, $d_1$; $c_2$, $d_2$; and $c_3$, $d_3$) in the above respective expressions (10), (11) and (12) are calculated on the basis of the expressions (14), (15).

Figure 13:
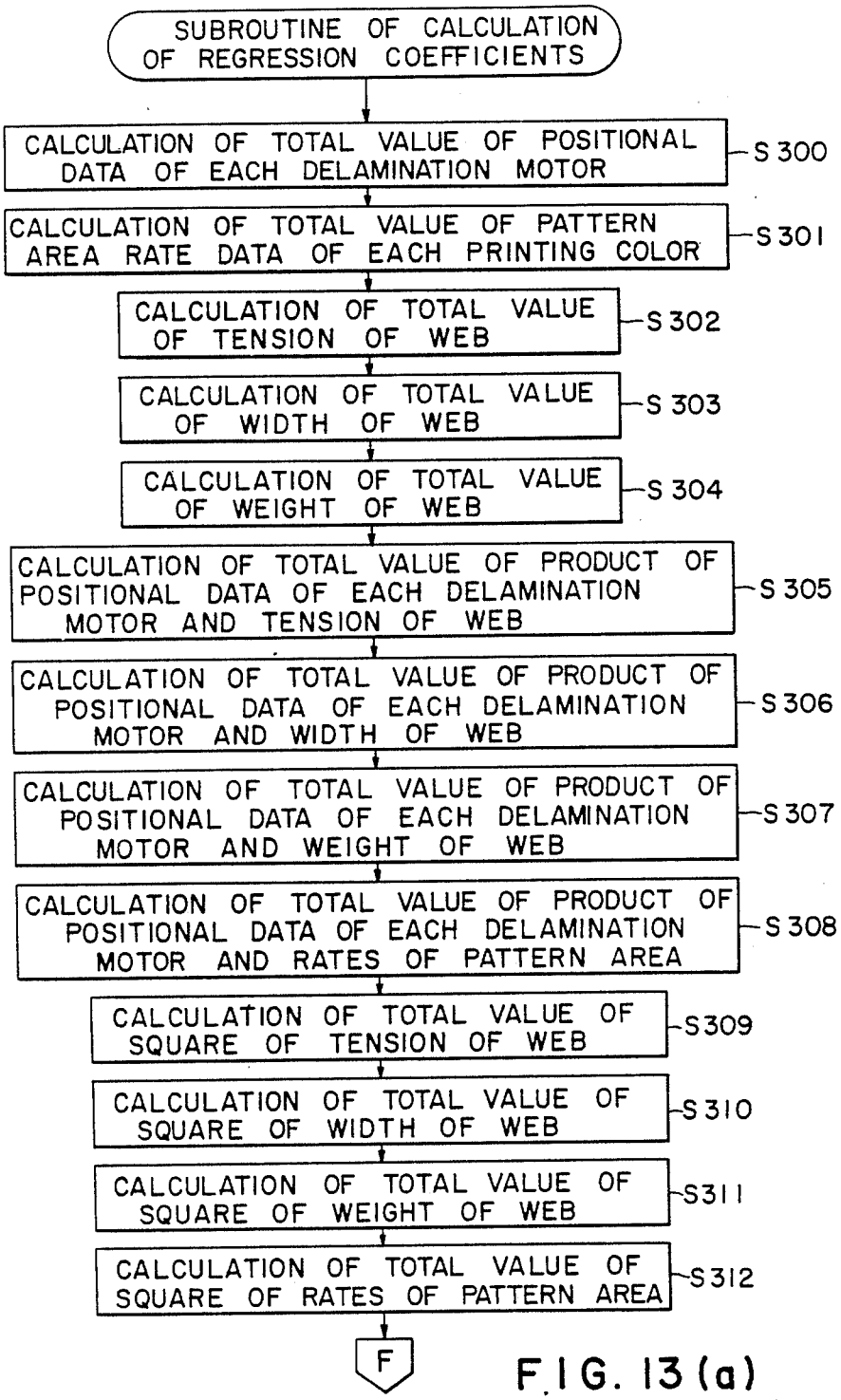
FIGS. 13(*a*) and (*b*) are flow charts showing a subroutine of four steps for calculating regression coefficients between the position of delamination deviation correcting motor and four printing conditions.
Figure 13:
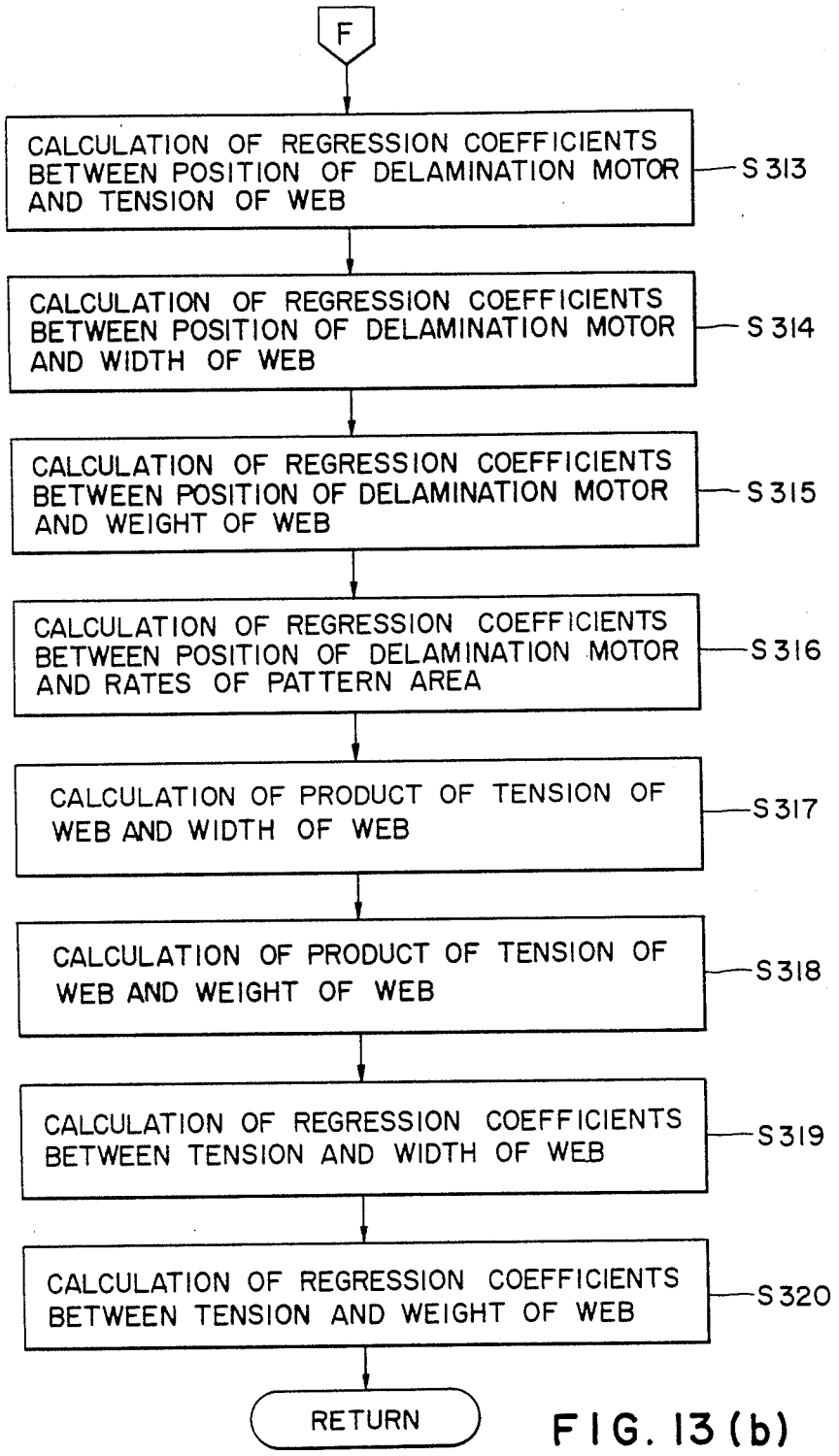

These four steps $S_{107}$, $S_{108}$, $S_{109}$ and $S_{110}$ are carried out in a manner as shown in FIG. 13.

With respect to the above expressions (14), (15), a total value of positional data of each delamination motor 26 is calculated to obtain $\Sigma y_i$ in the expression (14) $S_{300}$). Likewise, a total value of data of rates of pattern area with respect to each printing color, a total value of data of tension of a web, a total value of data of width of a web and a total value of data of weight of a web are calculated, respectively, to obtain $\Sigma x_i$ in the expression (14) $S_{302}$, $S_{303}$, $S_{304}$). Then, total values of product of positional data of each delamination motor 26 and four respective printing conditions such as tension, width and weight of a web and rates of pattern area are calculated to obtain $\Sigma y_i x_i$ in the expression (14) $S_{305}$, $S_{306}$, $S_{307}$, $S_{308}$). Furthermore, total values of square of tension, width and weight of a web and rates of pattern area are calculated to obtain $\Sigma x_i^2$ in the expression (14), respectively $S_{309}$, $S_{310}$, $S_{311}$, $S_{312}$). Next, the regression coefficients ($c_0$, $d_0$ . . . values between position of each delamination motor 26 and tension of a web; $c_1$, $d_1$, . . . values between position of each delamination motor 26 and width of a web; $c_2$, $d_2$ . . . values between position of each delamination motor 26 and weight of a web; and $c_3$, $d_3$ . . . values between position of each delamination motor 26 and rates of pattern area) are calculated on the basis of the expressions (14), (15) ($S_{313}$, $S_{314}$, $S_{315}$, $S_{316}$).

After this, four regression coefficients ($a_0$, $b_0$; $a_1$, $b_1$) with respect to the expressions (7), (8) in which tension T is a dependent variable and weight of a web and width of a web are independent variables are calculated on the basis of the expressions (14), (15), respectively. In this case, as total values of tension, width and weight of a web has been calculated in the steps $S_{302}$, $S_{303}$, $S_{304}$), respectively, only a total value of product of tension of a web and width of a web and a total value of product of tension of a web and width of a web are calculated, respectively ($S_{317}$, $S_{318}$). Then, the four regression coefficients ($a_0$, $b_0$; $a_1$, $b_1$) are calculated, respectively, $S_{319}$, $S_{320}$).

After this, each plate cylinder is rotated to detect the register marks m, m on the opposite sides of the printing plate 60 by the sensors 61. The above circuits 69, 71, 73 detect the magnitudes of the rotational phase, lateral and twist errors of all cylinders 1*a*, 1*b*, respectively. The detection signals by the three circuits 69, 71, 73 are sent to the motor driving circuits 70, 72, 74, respectively, to rotate the respective correcting motors 20, 21, 22 and 23, 24, 25 for correcting the respective errors in the above described manner with reference to FIGS. 4 to 7. In this manner, the upper and lower plate cylinders 2*a*, 2*b* are preset in their respective correct positions in the case of no delamination error ($S_{111}$)(FIG. 12).

Thereafter, the correction for a delamination error is carried out in the following manner.

If completion of the presetting of each plate cylinder is displayed ($S_{112}$), its completion is confirmed $S_{113}$) and width and weight of a web to be used are input by the key board type input unit 84 into the computer C while rates of pattern area of each printing plate are input from the pattern area input device 97 in a manner as shown in FIG. 14 ($S_{114}$, $S_{115}$, $S_{116}$). Then, the most suitable tension value to be preset is calculated on the basis of data concerning width and weight of a web to be printed. That is, as the regression coefficients of the two respective functional expressions (7), (8) between tension and width of a web and between tension and weight of a web have been already calculated in the subroutine steps ($S_{319}$, $S_{320}$) of FIG. 13, the most suitable tension value to be preset is calculated on the basis of the above expression (16) ($S_{117}$). After the most suitable tension value is determined, the CPU 80 commands to drive the tension adjusting motor 95 ($S_{118}$). Next, the present tension value is read ($S_{119}$) and compared with the calculated tension of the web ($S_{120}$). When the calculated tension value coincides with the actual tension of the web, the tension adjusting motor 95 is stopped ($S_{121}$).

Now, the computer C is ready for calculating a delamination error of the first printing color (the printing unit $U_1$) on the basis of the above expression (17) ($S_{122}$). Delamination deviation correcting operation between the first and second printing colors is carried out in such a manner that the delamination deviation correcting motor 26 on the second printing color unit $U_2$ is adjusted on the basis of the calculated delamination error of the first printing color. Likewise, delamination deviation correcting operations between the second and the third printing colors and between the third and fourth printing colors are carried out in such a manner that the motors 26 on the third and fourth printing color units $U_3$, $U_4$ are adjusted on the basis of the calculated delamination errors of the second and third printing colors, respectively.

In the delamination deviation correcting operation between the first and second printing colors, the output signal concerning the delamination error of the first color is output to the delamination deviation correcting motor 26 of the second printing color through the D/A converter 92 and the drive circuit 94 ($S_{123}$). The potentiometer 35 detects whether or not the helical gear 16 of the motor 26 is located in the most suitable position ($S_{124}$) corresponding to the calculated delamination error and the motor 26 is stopped when the potentiometer 35 detects the arrival of the helical gear 16 at the most suitable position indicated by the CPU 80 ($S_{125}$). The same operations are then carried out between the second and third printing colors and between the third and fourth printing colors, respectively ($S_{126}$ to $S_{136}$).

In spite of this procedure, when shear of colors is found on a printed article, each motor 26 is driven to move slightly each helical gear 16 until delamination errors are eliminated ($S_{137}$). That is, the operator repeats proofings while adjusting each delamination error. If a correct printing without shear of colors is carried out, the operator puts an OK key of the input unit 84 ($S_{138}$, $S_{139}$). Thereafter, position of each motor 26 and tension value of the web are read by each potentiometer 35 and the tension sensor 90, respectively when a correct printing is carried out ($S_{140}$, $S_{141}$) in order to obtain data for recalculation of the regression coefficients in the steps ($S_{142}$ to $S_{145}$).

Figure 15:
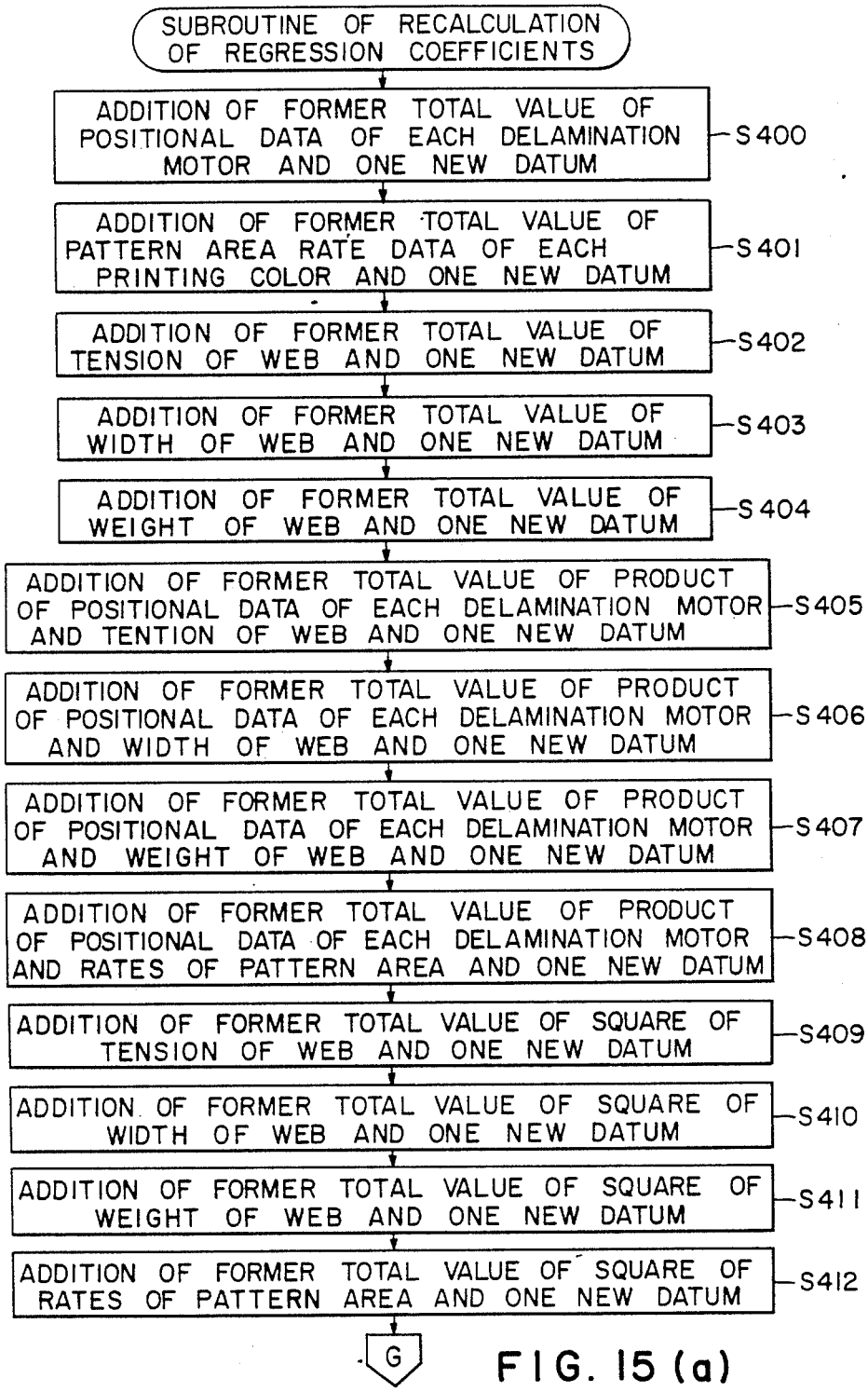
FIGS. 15(*a*) and (*b*) are flow charts showing a subroutine of four steps for recalculating regression coefficients between the position of delamination deviation correcting motor and four printing conditions.
Figure 15:
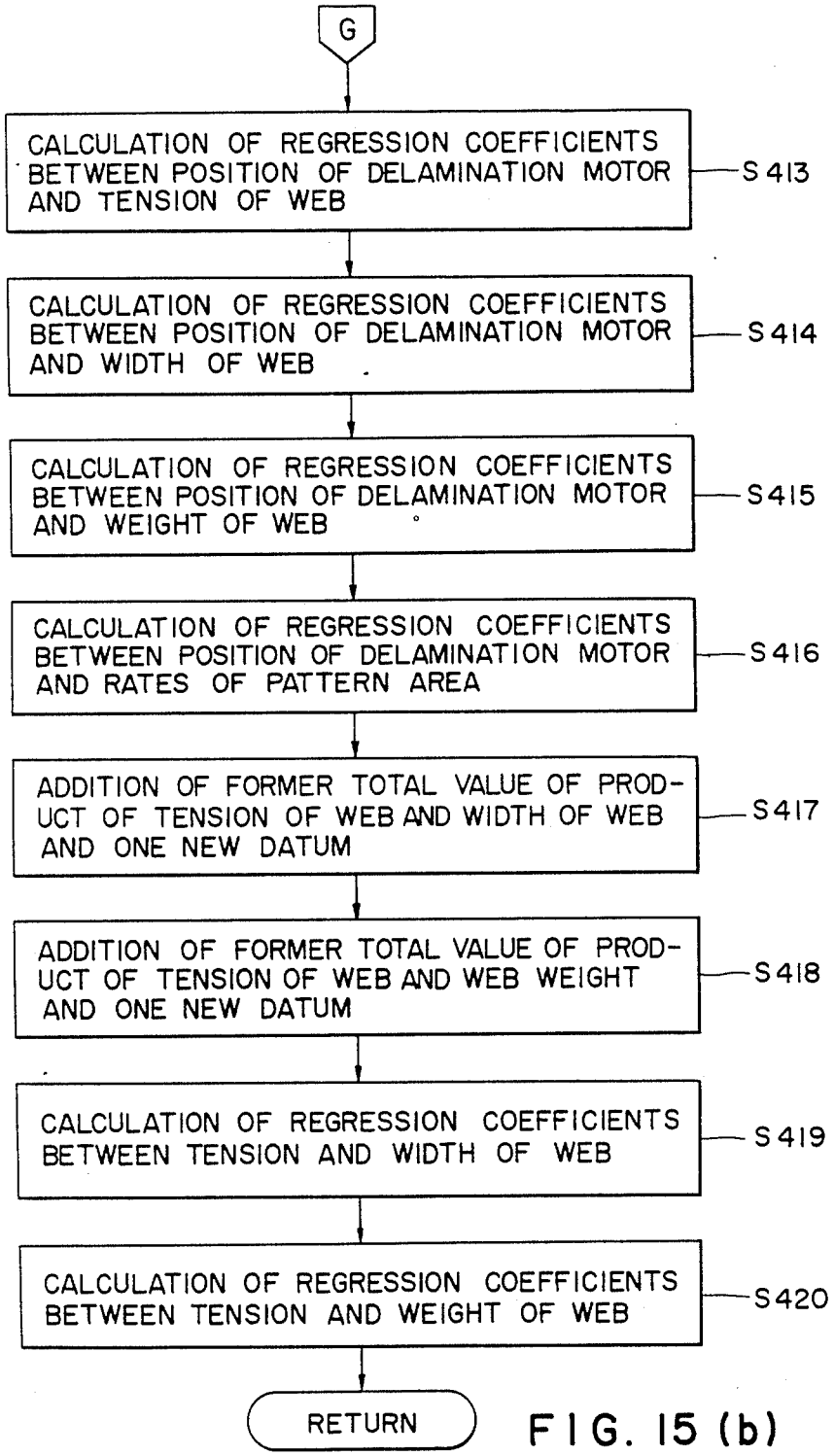

These recalculation steps are carried out in a manner as shown in FIG. 15. In FIG. 15, the steps $S_{400}$ to $S_{420}$ are similar to the steps ($S_{300}$ to $S_{320}$) of FIG. 13. In the above steps ($S_{137}$ to $S_{141}$), one new datum for adjusting delamination errors can be obtained in addition to the ten data obtained in the steps ($S_{100}$ to $S_{106}$). Accordingly, a total value of each element (position of each delamination motor 26; rates of pattern area of each printing color; tension of a web; weight of a web; width of a web; respective products of position of each delamination motor 26 and tension of a web, width and weight of a web and rates of pattern area; and respective squares of tension of a web, width and weight of a web and rates of pattern area) is calculated in such a manner that the one new datum obtained in the steps ($S_{137}$ to $S_{141}$) is added to the total value of the ten data of each element obtained in the above steps ($S_{100}$ to $S_{106}$) of FIG. 12. That is, for example, a total value $$\left(\sum_{i=1}^{11} y_i\right)$$

of position of the delamination motor 26 is expressed as $$\sum_{i=1}^{11} y_i = \sum_{i=1}^{10} y_i + y_{11}.$$

Further, a total value of tension of a web;

$$\left(\sum_{i=1}^{10} x_i\right)$$

is expressed as $$\sum_{i=1}^{11} x_i = \sum_{i=1}^{10} x_i + x_{10}.$$

The steps ($S_{400}$ to $S_{420}$) are the same as those steps to ($S_{300}$ to $S_{320}$) with the exception of the addition operations. Thus, respective regression coefficients are recalculated on the basis of eleven data with respect to each element to be calculated.

On the basis of the recalculated regression coefficients, presetting operation of each plate cylinder is carried out again. Such a self-learning is repeated many times to obtain respective correct regression coefficients.

Figure 9:
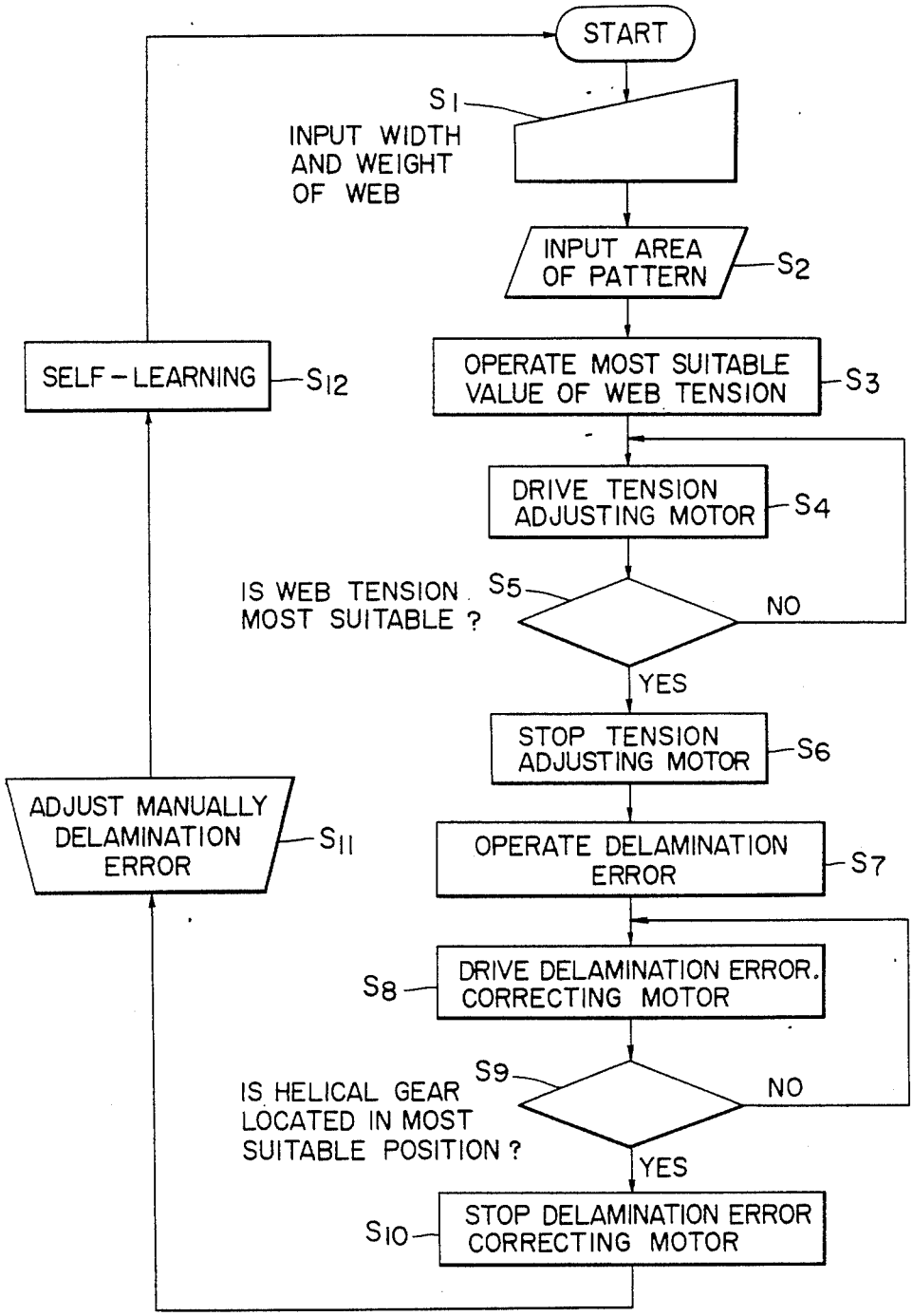
FIG. 9 is a flow chart showing registering for delamination errors.

FIG. 9 shows a simple flow chart for showing a self-learning operation. That is, FIG. 9 corresponds to a flow chart obtained by simplifying the flow chart of FIG. 12 in such a manner that some important steps of FIG. 12 are picked up.

The steps ($S_{114}$, $S_{115}$) of FIG. 12 correspond to the step ($S_1$) of FIG. 9. The steps ($S_{118}$, $S_{119}$, $S_{120}$, $S_{121}$) of FIG. 12 correspond to the steps ($S_4$, $S_5$, $S_6$) of FIG. 9. The steps ($S_{122}$ to $S_{136}$) of FIG. 12 correspond to the steps ($S_7$ to $S_{10}$) of FIG. 9. Further, the steps ($S_{137}$ to $S_{145}$) of FIG. 12 correspond to the steps ($S_{11}$, $S_{12}$) of FIG. 9.

The following table shows a result of the self-learning. In this table, $1^c$, $2^c$, and $3^c$ of rates of pattern area column mean the first, second and third printing color corresponding to the first, second and third printing units ($U_1$, $U_2$ and $U_3$) and, for example, $1^c-2^c$ of shear of colors column (delamination error) mean the position between the first and second printing colors (units). The calculated values of the two columns of infeed tension and shear of colors mean the respective tension and delamination error values calculated according to the method of this invention, respectively. Further, the OK values of the same column mean the respective values obtained after each delamination error is slightly adjusted by the operator. The test is carried out with respect to six kinds of webs A to F.

TABLE

| Test No. | Web Kind | Width [mm] | Weight [kg] | Rates of pattern area Position | (%) | Infeed tension (kg) Calculated value | OK value | Shear of colors Position | Calculated value | OK value |
|---|---|---|---|---|---|---|---|---|---|---|
| 1 | A | 765 | 72 | $1^c$ | 20 | 51 | 56 | $1^c-2^c$ | 1.2 | 1.6 |
| | | | | $2^c$ | 23 | | | $2^c-3^c$ | 0.9 | 0.5 |
| | | | | $3^c$ | 18 | | | $3^c-4^c$ | 1.0 | 1.5 |
| 2 | B | 880 | 82 | $1^c$ | 15 | 61 | 64 | $1^c-2^c$ | 1.3 | 1.0 |
| | | | | $2^c$ | 25 | | | $2^c-3^c$ | 0.9 | 1.3 |
| | | | | $3^c$ | 33 | | | $3^c-4^c$ | 0.8 | 0.5 |
| 3 | C | 765 | 49 | $1^c$ | 17 | 43 | 40 | $1^c-2^c$ | 1.2 | 1.0 |
| | | | | $2^c$ | 22 | | | $2^c-3^c$ | 0.8 | 1.0 |
| | | | | $3^c$ | 18 | | | $3^c-4^c$ | 1.2 | 1.0 |
| 4 | D | 813 | 57 | $1^c$ | 19 | 49 | 48 | $1^c-2^c$ | 1.2 | 0.9 |
| | | | | $2^c$ | 18 | | | $2^c-3^c$ | 0.9 | 1.2 |
| | | | | $3^c$ | 23 | | | $3^c-4^c$ | 1.1 | 0.9 |
| 5 | E | 765 | 60 | $1^c$ | 33 | 47 | 48 | $1^c-2^c$ | 1.1 | 1.0 |
| | | | | $2^c$ | 40 | | | $2^c-3^c$ | 1.0 | 1.1 |
| | | | | $3^c$ | 11 | | | $3^c-4^c$ | 1.2 | 1.1 |
| 6 | F | 860 | 89 | $1^c$ | 19 | 63 | 60 | $1^c-2^c$ | 1.2 | 1.4 |
| | | | | $2^c$ | 20 | | | $2^c-3^c$ | 1.0 | 0.8 |
| | | | | $3^c$ | 31 | | | $3^c-4^c$ | 0.8 | 0.6 |

Figure 16:
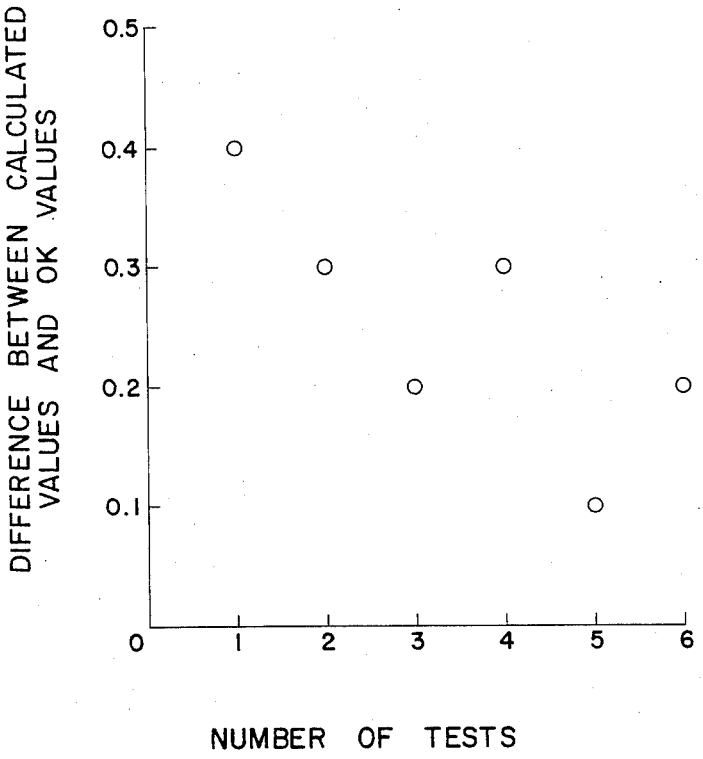
FIG. 16 is a graph showing a result of experiments according to this invention.

FIG. 16 shows differences between calculated and OK values of shear of colors in respective tests. According to FIG. 16, it is understood that difference between a calculated value and an OK value thereof is, in general, decreased as a test is repeated.

When a correct printing operation is carried out with respect to a certain web, a positional signal of the potentiometer 87 at that time is memorized by the RAM 85. In the case that the same web as before is used, the previous positional signal is read out from the RAM 85 to locate the helical gear 16 in a correct position.

In the above embodiment, the delamination deviation correcting motor 26 is used only when a delamination error is adjusted after a rotational phase, lateral and twist errors are adjusted. However, in each printing unit, the delamination deviation correcting motor 26 may be also used as a rotational phase error correcting motor for correcting the rotational phase error of either of the upper and lower cylinders 2*a*, 2*b*. That is, in this case, the motor 26 is used for adjusting a rotational phase error caused by the mounting of a printing plate onto a plate cylinder and a delamination. In the case where the motor 26 is used in this manner, either of the rotational phase error correcting motors 22 and 25 can be eliminated. If the rotational phase error correcting motor 25 for the lower plate cylinder 2*b* is eliminated, the correction of the rotational phase error of the lower plate cylinder 2*b* is carried out by the motor 26 while detecting the register marks m by the sensors 61. Thereafter, the correction of the rotational phase error of the upper plate cylinder 2*a* is carried out by the motor 22 or 25 for the upper plate cylinder 2*a* in the above described manner. When the delamination error is adjusted, the motor 26 is used again. At this time, the magnitude of the adjustment of the gear 16 must be determined in consideration of the magnitude of the adjustment thereof having been carried out in order to correct the rotational phase error of the lower plate cylinder 2*b*.

According to the presetting apparatus of this invention, a delamination error is effectively eliminated to carry out a perfectly automatic registering. Accordingly, a period of time for registering can be remarkably reduced and a waste of paper can be remarkably decreased. Furthermore, the tension of a web which is conventionally adjusted on the basis of operator's experiences can be automatically preset through selflearning of a computer to cause a printing operation with a proper tension of the web. This results in preventing the web from tearing because of its improper tension.

In the above embodiment, the computer C is used. Instead of the computer C, a wired logic system may be used.

What is claimed is:

1. A method of presetting plate cylinders for registering before the start of a printing operation in an offset printing press in which a web runs between surfaces of opposed rotating blanket cylinders for the plate cylinders, the method comprising the steps of:

(a) correcting rotation phase, lateral and twist errors of each plate cylinder without considering a delamination error defined by a rotational phase error caused by the web being drawn in a rotational direction of a blanket cylinder due to adherence of the web onto an inked surface of the blanket cylinder, while detecting register marks on a printing plate mounted on each plate cylinder;

(b) calculating tension of a web on the basis of a functional expression with respect to at least one of width and weight per unit length of the web and operating tension adjusting means on the basis of a calculated value of web tension;

(c) calculating the delamination error of each plate cylinder corresponding to each printing color on the basis of at least one functional expression with respect to at least one of the calculated tension, width, weight per unit length and rates of pattern area and operating delamination error correcting means on the basis of a calculated value of a delamination error with respect to each plate cylinder corresponding to each printing color; and (d) carrying out self-learning in which an operator manually adjusts the delamination error correcting means until delamination errors are eliminated while viewing shear of colors on printed articles to determine a suitable web tension and delamination error when shear of colors is eliminated, the suitable web tension and delamination error being used when coefficients of the functional expressions with respect to web tensions and delimination errors are calculated for subsequent printing operations.

2. A method according to claim 1, wherein web tension and each delamination error corresponding to each printing color are determined on the basis of regression analysis.

3. A method according to claim 2, wherein web tension is expressed by two regression lines one of which uses weight per unit length of a web as an independent variable, the other of which uses width of a web as an independent variable while each delamination error is expressed by four regression lines each using one of the web tension, weight per unit length of a web, width of a web and rates of pattern area as an independent variable, and a suitable web tension and each delamination error are determined by averaging dependent variables of the regression lines corresponding to web tension and each delamination error, respectively.

* * * * *